US008136297B2

(12) United States Patent
Bzorgi

(10) Patent No.: US 8,136,297 B2
(45) Date of Patent: Mar. 20, 2012

(54) SPEED CONTROL SYSTEM FOR AN ACCESS GATE

(75) Inventor: Fariborz M. Bzorgi, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 1075 days.

(21) Appl. No.: 11/863,708

(22) Filed: Sep. 28, 2007

(65) Prior Publication Data

US 2009/0084037 A1 Apr. 2, 2009

(51) Int. Cl.
*E05D 15/02* (2006.01)

(52) U.S. Cl. ..... 49/43; 49/138

(58) Field of Classification Search ..... 49/138, 49/42, 43; 192/12 B

See application file for complete search history.

(56) References Cited

U.S. PATENT DOCUMENTS

| | | | | |
|---|---|---|---|---|
| 1,578,660 | A * | 3/1926 | Hedley et al. | 49/43 |
| 2,029,318 | A * | 2/1936 | Hagenbook | 188/187 |
| 2,029,914 | A * | 2/1936 | Dreher | 49/43 |
| 2,050,584 | A * | 8/1936 | Peremi et al. | 49/43 |
| 2,316,184 | A * | 4/1943 | Peremi et al. | 188/187 |
| 2,954,971 | A * | 10/1960 | Simpson | 49/29 |
| 3,307,660 | A | 3/1967 | Sheckells | |
| 3,364,620 | A * | 1/1968 | Hess et al. | 49/43 |
| 3,403,571 | A * | 10/1968 | Sheckells | 74/421 R |
| 3,678,623 | A * | 7/1972 | Jenkins | 49/43 |
| 3,766,686 | A * | 10/1973 | Sheckells | 49/43 |
| 3,897,651 | A * | 8/1975 | Sheckells | 49/43 |
| 3,968,595 | A | 7/1976 | Sheckells | |
| 3,998,008 | A | 12/1976 | Collins | |
| 4,020,927 | A | 5/1977 | Collins | |
| 4,976,065 | A | 12/1990 | Beran et al. | |

(Continued)

FOREIGN PATENT DOCUMENTS

| | | |
|---|---|---|
| CA | 869280 | 4/1971 |

(Continued)

*Primary Examiner* — Jerry Redman

(74) *Attorney, Agent, or Firm* — Michael J. Renner, Esq.; Luedeka Neely Group, P.C.

(57) ABSTRACT

An access control apparatus for an access gate. The access gate typically has a rotator that is configured to rotate around a rotator axis at a first variable speed in a forward direction. The access control apparatus may include a transmission that typically has an input element that is operatively connected to the rotator. The input element is generally configured to rotate at an input speed that is proportional to the first variable speed. The transmission typically also has an output element that has an output speed that is higher than the input speed. The input element and the output element may rotate around a common transmission axis. A retardation mechanism may be employed. The retardation mechanism is typically configured to rotate around a retardation mechanism axis. Generally the retardation mechanism is operatively connected to the output element of the transmission and is configured to retard motion of the access gate in the forward direction when the first variable speed is above a control-limit speed. In many embodiments the transmission axis and the retardation mechanism axis are substantially co-axial. Some embodiments include a freewheel/catch mechanism that has an input connection that is operatively connected to the rotator. The input connection may be configured to engage an output connection when the rotator is rotated at the first variable speed in a forward direction and configured for substantially unrestricted rotation when the rotator is rotated in a reverse direction opposite the forward direction. The input element of the transmission is typically operatively connected to the output connection of the freewheel/catch mechanism.

4 Claims, 3 Drawing Sheets

U.S. PATENT DOCUMENTS

| | | | | |
|---|---|---|---|---|
| 5,647,173 | A * | 7/1997 | Stark et al. | 49/506 |
| 5,653,056 | A * | 8/1997 | Stark | 49/43 |
| 5,773,943 | A * | 6/1998 | Andersen | 318/432 |
| 5,901,817 | A | 5/1999 | Gitnes | |
| 6,058,652 | A | 5/2000 | Uhl | |
| 6,092,336 | A * | 7/2000 | Wright et al. | 49/339 |
| 6,478,129 | B2 * | 11/2002 | Lambertini | 192/105 CD |
| 2003/0196868 | A1 * | 10/2003 | Liu et al. | 192/223.1 |
| 2005/0155289 | A1 * | 7/2005 | Oberheide | 49/340 |

FOREIGN PATENT DOCUMENTS

| | | |
|---|---|---|
| DE | 3424046 | 1/1986 |
| EP | 0171301 | 6/1985 |
| EP | 0761925 | 8/1996 |
| JP | 2005299120 | 10/2005 |
| WO | W02006082319 | 8/2006 |

* cited by examiner

SPEED CONTROL SYSTEM FOR AN ACCESS GATE

GOVERNMENT RIGHTS

The U.S. Government has rights to this invention pursuant to contract number DE-AC05-00OR22800 between the U.S. Department of Energy and BWXT Y-12, L.L.C.

FIELD

This disclosure relates to the field of turnstiles and gates. More particularly, this disclosure relates to access gates configured to control the flow of people and vehicles into and out of a controlled access area.

BACKGROUND

Gates, turnstiles, revolving doors, sliding doors, roll-up doors and similar devices (collectively referred to herein as access gates) are often used to control the flow of people and vehicles into and out from controlled access areas. As used herein the term "control" means to permit, restrict, or prevent a specified activity. In many circumstances it is desirable to control the motion of an access gate in a certain way. For example, in access gates that are configured to accommodate the entry, passage, and exit of multiple persons simultaneously through the access gate, an action of one such person to excessively speed up the rate of motion of the access gate could endanger the safety of others. It is desirable to prevent such an action. In gates such as sliding gates and doors, and rolling doors that open and close to permit the passage of persons or vehicles, an action that causes an excessive rate of speed of the access gate when opening or closing may endanger persons passing through the access gate. It is also desirable to prevent that action. Further, in some installations of access gates such as in prisons, at entry portals into high security government and civilian facilities, and at border crossings, there is a possibility that the access gate may be subjected to an attack, such as a riot, a massive assault, or a stampede. In such installations it is desirable to control the rate at which persons may pass through the access gate. Current gate access systems typically do not adequately address these considerations. What are needed therefore are improved systems to more effectively control the motion of an access gate.

SUMMARY

The present disclosure provides an embodiment of an access control apparatus for an access gate that includes a rotator that is configured to rotate around a rotator axis at a first variable speed in a forward direction. The access control apparatus has a transmission that includes an input element that is operatively connected to the rotator, where the input element is configured to rotate at an input speed proportional to the first variable speed. The transmission further includes an output element that has an output speed that is different than the input speed. There is a retardation mechanism that is configured to rotate around a retardation mechanism axis, and the retardation mechanism is operatively connected to the output element of the transmission and is configured to retard motion of the access gate in the forward direction when the first variable speed is above a control-limit speed. In this embodiment the transmission axis and the retardation mechanism axis are substantially co-axial.

The present disclosure also provides a further embodiment of an access control apparatus for an access gate that has a rotator configured to rotate at a first variable speed in a forward direction. In this embodiment the access control apparatus has a freewheel/catch mechanism that has an input connection that is operatively connected to the rotator, where the input connection is configured to engage an output connection of the freewheel/catch mechanism when the rotator is rotated at the first variable speed in the forward direction and the input connection is configured for substantially unrestricted rotation when the rotator is rotated in a reverse direction opposite the forward direction. The access control apparatus also has a retardation mechanism that is operatively connected to the output connection of the freewheel/catch mechanism, and the retardation mechanism is configured to retard motion of the access gate in the forward direction when the first variable speed is above a control-limit speed.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of an access control apparatus for an access gate. It is to be understood that other embodiments may be utilized, and that structural changes may be made and processes may vary in other embodiments.

As previously indicated, gates, turnstiles, revolving doors, sliding doors, roll-up doors and similar access gate devices are often used to control the flow of persons and vehicles into controlled access areas. In many circumstances it may be desirable to limit the speed at which persons are able to pass through an access gate. For example, persons proceeding through an access gate under normal orderly circumstances walk at a "normal" pace. Persons who are attempting to proceed through an access gate in a disorderly manner generally attempt to proceed at a pace that is considerably faster than "normal." To bring disorderly circumstances under control it may be helpful to limit the speed at which persons may proceed through the access gate. Often such control may be established by limiting the speed at which the access gate moves.

With some access gates, such as sliding gates or doors and roll-up doors, it is also sometimes desirable to limit the speed at which the access gate moves. An excessive rate of speed may cause the access gate to impact persons or vehicles passing through the gate, or may cause damage to the access gate if it closes at an excessive speed. Preventing the operation of turnstiles and similar access gates at an excessive speed is also important from a safety consideration.

What constitutes an "excessive speed" depends on the particular design of the access gate and its application. Typically there is a "control-limit speed" beyond which it is desirable to retard speed increases. Retarding speed increases refers to requiring an ever-increasing force on a portion of the access gate in order to move the access gate at increasing speeds above the control-limit speed.

In some circumstances it may be desirable to control the passage of persons or vehicles proceeding through an access gate in one direction (i.e., a "controlled direction") while permitting persons to proceed through the access gate in a different direction (typically the direction opposite the controlled direction) in a substantially unrestrained fashion. For example, it may be important to moderate the passage of persons into a sports venue (the controlled direction) while also permitting persons to exit the sports venue substantially without restraint in order to accommodate emergency evacuation circumstances.

Figure 1:
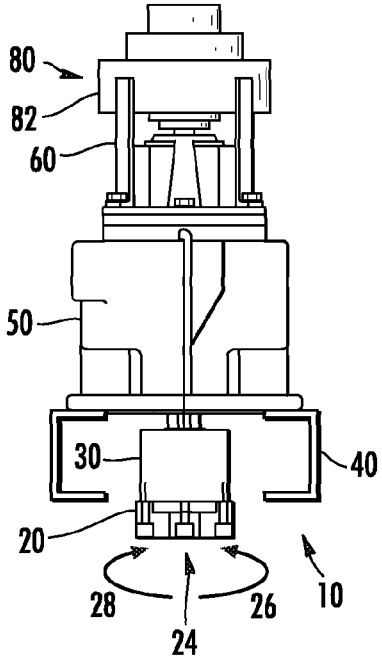
FIG. 1 is a somewhat schematic elevation view of an access control apparatus for an access gate.

One embodiment of an access control apparatus 10 for an access gate that addresses many of these and other considerations is illustrated in FIG. 1. The access control apparatus 10 includes an adapter 20 that is operatively connected to a freewheel/catch mechanism 30. As used herein, the term "operatively connected to" (or variations thereof such as "in operative connection with") refers to an arrangement of the recited elements that establishes either a static connection between or a kinetic interaction between the recited elements, either by direct attachment of the elements together or by connection of the recited elements through one or more intervening elements. "Static connection" refers to an arrangement where one recited element and at least a second recited element do not move with respect to each other. "Kinetic interaction" refers to an arrangement where one recited element may move with respect to at least a second recited element with such movement controlled by the connection of the recited elements and, if applicable, any intervening elements.

The adapter 20 has a drive connection 24. The drive connection 24 is configured to rotate in a forward direction 26 and a backward direction 28. The drive connection 24 is typically configured to be operatively connected to a rotating element of an access gate. The adapter 20 is operatively connected to the freewheel/catch mechanism 30. As explained later in more detail, the freewheel/catch mechanism 30 may be configured to control the rotation of the adapter 20 in either the forward direction 26 or a backward direction 28, or to control the rotation of the adapter 20 in both the forward direction 26 and the backward direction 28.

The access control apparatus 10 of FIG. 1 further includes a mounting bracket structure 40 for attaching the access control apparatus 10 to the access gate. The access control apparatus 10 of FIG. 1 also includes a transmission 50 that is operatively connected to the freewheel/catch mechanism 30. In the embodiment of FIG. 1 the transmission 50 is a gearbox. In alternative embodiments the transmission may be a hydraulic transmission or a belt-driven transmission or a similar mechanism.

As further illustrated in FIG. 1, a retardation mechanism 80 is operatively connected to the transmission 50. Mounting posts 60 are used to align and support the retardation mechanism 80 in relationship to the transmission 50. In the embodiment of FIG. 1 the retardation mechanism 80 is a centrifugal friction clutch. A centrifugal clutch is a clutch having friction pads or shoes radially mounted around a driven shaft. The pads or shoes swing outward and engage the inside of the rim of a housing with increasing force against the rim as the rotational speed of the drive shaft increases. Springs are typically used to restrain the outward swing of the pads or shoes, and to withdraw the pads or shoes from the rim when the driven shaft is not rotating.

In the embodiment of FIG. 1 a housing 82 of the retardation mechanism 80 is secured to a portion of the frame of the access gate through the mounting posts 60, the transmission 50 and the mounting bracket structure 40, so that the centrifugal clutch acts as a brake when the speed of the driven shaft is above a control-limit speed. The control-limit speed may be established by safety concerns or may be set at a speed designed to prevent gate crashing or other disorderly conduct. In alternative embodiments the speed retardation mechanism 80 may be a centrifugal speed governor, a hydraulic turbine governor, or a similar mechanism instead of a centrifugal clutch.

Figure 2:
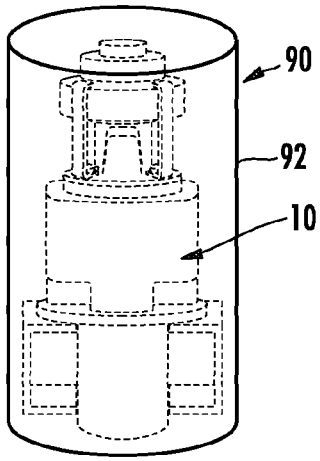
FIG. 2 is a somewhat schematic perspective view of an access control assembly that includes an access control apparatus for an access gate.

FIG. 2 illustrates an access control assembly 90 that includes a cover 92 installed over the access control apparatus 10 of FIG. 1.

Figure 3:
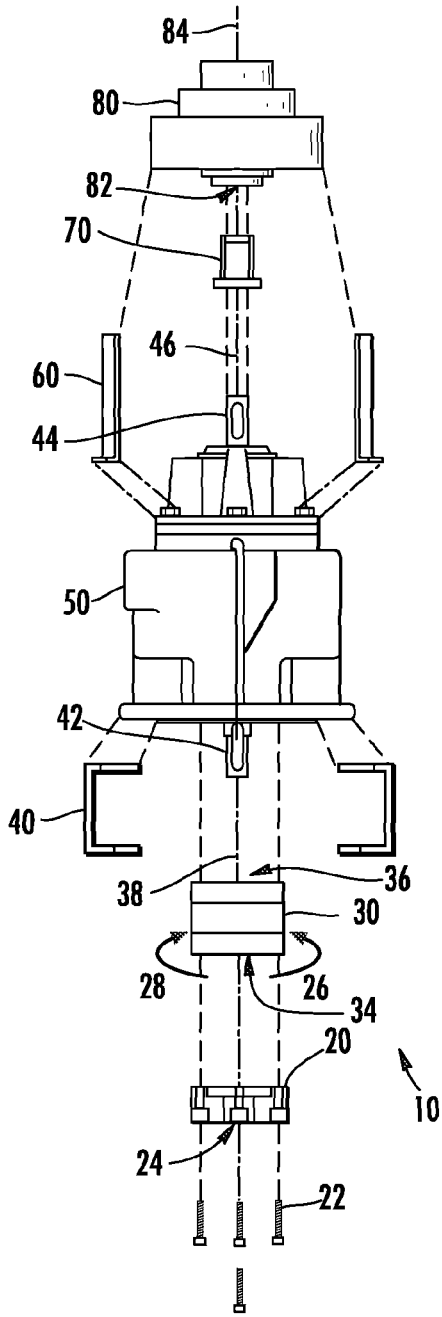
FIG. 3 is a somewhat schematic exploded view of the access control apparatus of FIG. 1.

FIG. 3 is an exploded view of the components of the access control apparatus 10. The adapter 20 is attached to the freewheel/catch mechanism 30 with machine screws 22. In the embodiments of FIGS. 1, 2, and 3, the freewheel/catch mechanism 30 is an overrunning clutch mechanism. An overrunning catch mechanism is a device that allows a driven shaft to turn faster than a driving shaft in a first rotational direction, and may also permit the driving shaft to rotate unrestricted in a second rotational direction that is opposite the first rotational direction. One example of the use of an overrunning clutch mechanism is in an engine starter where the cranked gear turns freely when the engine starts to run. Another example of the use of an overrunning clutch mechanism is in a typical chain and sprocket driven bicycle. In such a bicycle, when the rider is coasting the driven shaft (the rear wheel axel) may turn in a first rotational direction at a rotation rate that is faster than the rotation rate of the driving shaft (the pedal shaft). Further, the rider may even pedal backwards (a second unrestricted rotational direction that is opposite the first rotational direction) without affecting the rotation of the wheels rotating in the first rotational direction. In alternative embodiments the freewheel/catch mechanism 30 may incorporate a mechanism other than an overrunning clutch to control these described rotational motions, such as a ratchet mechanism or a pawl and sprocket mechanism.

In the embodiment of FIGS. 1, 2 and 3, the drive connection 24 is operatively connected to an input connection 34 of the freewheel/catch mechanism 30 at least in part through the adapter 20. The freewheel/catch mechanism 30 may be configured so that the input connection 34 engages an output connection 36 of the freewheel/catch mechanism 30 to establish a controlled rotation direction when the drive connection 24 rotates in the forward direction 26, and the input connection 34 may be configured to permit substantially unrestricted rotation in a "freewheeling rotation direction" when the drive connection 24 rotates in the backward direction 28. As used herein the term "controlled rotation" refers to a rotation that may be mechanically resisted if the rate of rotation exceeds a control-limit speed. As used herein, the term "substantially unrestricted rotation" refers to unrestricted (except for incidental friction) revolution through 360° of rotation and all multiples thereof.

The input connection 34 and the output connection 36 are coaxial and establish a freewheel/catch mechanism axis 38. In some embodiments, particularly where the freewheel/catch mechanism 30 comprises an overrunning clutch, the input connection 34 and the output connection 36 of the freewheel/catch mechanism 30 are identical mechanical interfaces, and in such embodiments the controlled rotation direction and the substantially unrestricted freewheeling rotation direction may be reversed by flipping the freewheel/catch mechanism 30 upside down. In some embodiments a freewheel/catch mechanism 30 may not be employed. In such embodiments the adapter 20 may be operationally connected to the transmission 50 without the intervening freewheel/catch mechanism 30.

Continuing with FIG. 3, the transmission 50 includes an input element 42 that in this embodiment connects to the output connection 36 of the freewheel/catch mechanism 30. The transmission also includes an output element 44. In the embodiment of FIGS. 1, 2 and 3, the input element 42 and the output element 44 are coaxial and establish a transmission axis 46. A coupling 70 is provided to connect the transmission 50 to a drive socket 82 of the retardation mechanism 80. The drive socket establishes a retardation mechanism axis 84. In the embodiment of FIGS. 1, 2, and 3 the freewheel/catch mechanism axis 38, the transmission axis 46 and the retardation mechanism axis 84 are co-axial. Also in this embodiment the transmission is a speed increaser wherein the ratio of the rotation speed of the output element 44 to the rotation speed of the input element 42 is approximately 70:1. The 70:1 ratio may vary in different embodiments, and is set as part of the design parameters that establish the control-limit speed of an access control apparatus. Other principal design parameters that affect the control-limit speed are (a) the strength of the springs (or equivalent structures) that restrict the outward motion of the pads or shoes, and (b) the surface area of the pads or shoes of the centrifugal clutch elements of the retardation mechanism 80.

Figure 4:
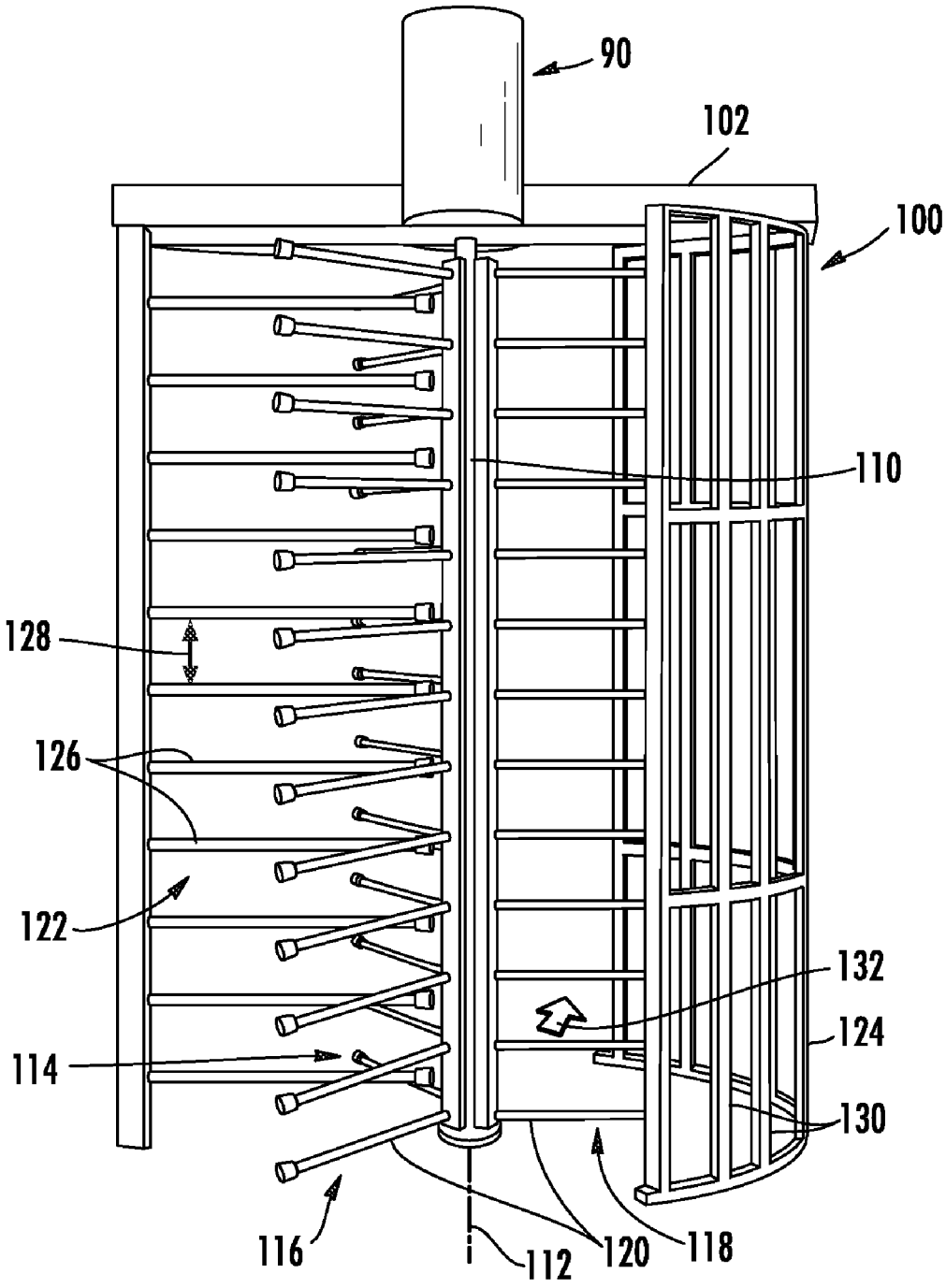
FIG. 4 is a somewhat schematic perspective view of a roto-gate having an access control assembly installed therewith.

FIG. 4 illustrates a roto-gate 100 with an access control assembly 90 installed. The roto-gate 100 is an example of an access gate. As previously indicated, the access control assembly 90 includes the access control apparatus 10 and the access control apparatus 10 is an example of a control apparatus for an access gate. The roto-gate 100 has a top frame member 102 that supports the access control assembly 90. The roto-gate 100 has a rotor 110 that revolves around a rotor axis 112. The rotor 110 is an example of a "rotator" as defined herein. The rotor 110 is operatively connected to the drive connection 24 of the access control apparatus 10 of the access control assembly 90. The rotor 110 has three rotating wings 114, 116, and 118 that rotate around the rotor axis 112. Each of the three rotating wings 114, 116, and 118 are formed substantially by a set of horizontal rotating spokes 120 that are fixedly attached to the rotor 110. The roto-gate 100 also has a stationary planar barrier 122 and stationary curved barrier 124. The stationary planar barrier 122 includes a plurality of horizontal stationary spokes 126 having spaces 128 between them. The stationary curved barrier 124 has a plurality of vertical stationary columns 130. The horizontal rotating spokes 120 are configured to rotate around the rotor axis 112 inside the vertical stationary columns 130 and through the spaces 128 between the horizontal stationary spokes 126.

The stationary planar barrier 122 and the stationary curved barrier 124 limit the passage of a person or object through the roto-gate 100 to only a path controlled by movement of the three rotating wings 114, 116, and 118 of the roto-gate 100. For example, when the roto-gate 100 is in the configuration depicted in FIG. 4 and a person pushes against the rotating wing 118 in the direction 132, the rotating wing 118 may rotate around the rotor axis 112, and the person may pass through the roto-gate 100. However, as previously-indicated, the rotor 110 is coupled to the drive connection 24 of the access control apparatus 10 of the access control assembly 90. As the person rotates the rotating wing 118 in the direction 132, the drive connection 24 of the access control apparatus 10 of the access control assembly 90 engages the input connection 34 of the freewheel/catch mechanism 30. If the freewheel/catch mechanism 30 is configured so that rotation in the direction 132 corresponds to the forward direction 26 of FIGS. 1 and 3, and the freewheel/catch mechanism 30 is configured to establish controlled rotation when the drive connection 24 rotates in the forward direction 26, then if the person pushes the rotating wing 118 at a rotation rate that turns the transmission 50 at a rate that exceeds the control-limit speed of the retardation mechanism 80, the retardation mechanism 80 will exert a resistance force that tends to limit an increase in the rotation rate of the rotating wing 118. If the freewheel/catch mechanism 30 is configured so that rotation in the direction 132 corresponds to the backward direction 28 of FIGS. 1 and 3, and the freewheel/catch mechanism 30 is configured to establish substantially unrestricted rotation in a freewheeling rotation direction when the drive connection 24 rotates in the backward direction 28, then the retardation mechanism 80 will not rotate to any significant extent and substantially no resistance force will be exerted to limit an increase in the rotation rate of the rotating wing 118.

As previously noted, some embodiments do not incorporate a freewheel/catch mechanism 30. In such embodiments the adapter 20 may be operatively connected to the input element 42 of the transmission 50 and the rotor 110 is coupled to the transmission 50 through the drive connection 24. In such embodiments the access control assembly 90 does not have a freewheeling rotation direction. That is, rotation in either direction of the rotor 110 above a rate that exceeds the control-limit speed of the retardation mechanism 80 causes the retardation mechanism 80 to exert a resistance force that tends to limit any increase in the rotation rate of the rotor 110.

Some embodiments prevent any significant rotation of an access gate rotator in a direction opposite the controlled rotation direction. In such embodiments a portion of the catch freewheel/catch mechanism 30 that rotates is fixedly secured to the top frame so that rotation of the freewheel/catch mechanism 30 is prevented in one direction. Typically in such embodiments the portion of the freewheel/catch mechanism 30 that rotates in the freewheeling rotation direction is fixedly secured to the top frame so that in the configuration of FIG. 4 rotation of the rotating wing 118 in the direction 132 is permitted and rotation of the rotating wing 118 in the opposite direction is prevented. When installed in this configuration, the access control assembly 90 depicted in FIG. 4 may provide controlled rotation in the direction 132 that corresponds to the forward direction 26 of FIGS. 1 and 3, and the freewheel/catch mechanism is then further configured for substantially no rotation when the rotator is rotated in a backward direction (28 in FIGS. 1 and 3) that is opposite the forward direction 26. Such a configuration may, for example, be used to permit an orderly exit of persons from a controlled access area while preventing any entry into the controlled access area.

Figure 5:
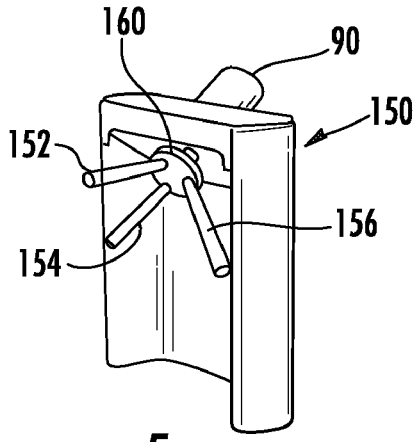
FIG. 5 is a somewhat schematic perspective view of a turnstile having an access control assembly installed therewith.

FIG. 5 is an illustration of a turnstile 150 that is configured with the access control assembly 90 installed. The turnstile 150 is an example of an access gate. The turnstile 150 has three arms 152, 154, and 156 that rotate around a spindle 160. The spindle 160 is an example of a rotator. The access control assembly 90 controls the rotation of the three arms 152, 154 and 156 around the spindle 160 in the same manner as the access control assembly 90 controls the rotation of the three rotating wings 114, 116, and 118 around the rotor 110 of the roto-gate 100 of FIG. 4.

Figure 6:
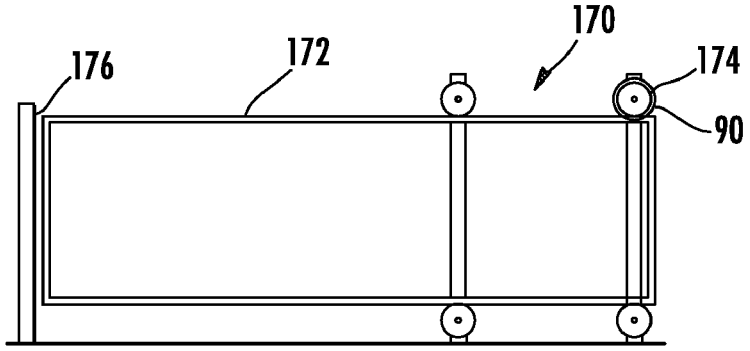
FIG. 6 is a somewhat schematic elevation view of a sliding gate having an access control assembly installed therewith.

FIG. 6 is an illustration of a sliding gate 170 that is configured with the access control mechanism 90 installed. The sliding gate 170 is an example of an access gate. The sliding gate 170 has a bar 172 and a roller arm 174. It may be desirable to control the speed of the lateral movement of the sliding gate 170 so that it does not crash into the post 176 or other objects at an excessively high speed. The bar 172 and the roller arm 174 are operatively connected so that lateral movement of the sliding gate 170, and in particular lateral movement of the bar 172, causes rotation of the roller arm 174. The access control assembly 90 controls the rotation of the roller arm 174 in the same manner as the access control assembly 90 controls the rotation of the three rotating wings 114, 116, and 118 around the rotor 110 of the roto-gate 100 of FIG. 4.

Figure 7:
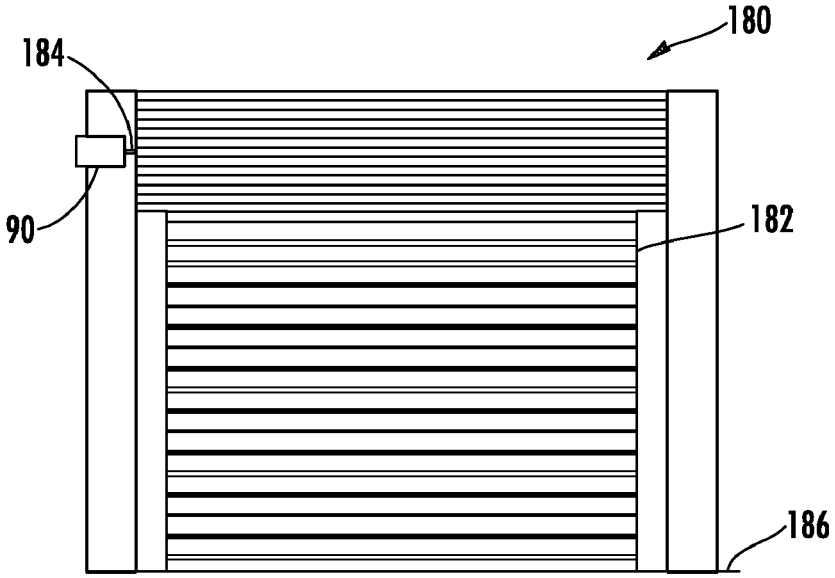
FIG. 7 is a somewhat schematic elevation view of a rolling door having an access control assembly installed therewith.

FIG. 7 is an illustration of a rolling door 180 that is configured with the access control mechanism 90 installed. The rolling door 180 is an example of an access gate. The rolling door 180 has slats 182 that are configured to roll up around a rod 184. It may be desirable to control the speed of the vertical movement of the rolling door 180 so that it does not crash into the floor 186 or other objects at an excessively high speed. The access control assembly 90 controls the rotation of the rod 184 in the same manner as the access control assembly 90 controls the rotation of the three rotating wings 114, 116, and 118 around the rotor 110 of the roto-gate 100 of FIG. 4.

In summary, embodiments disclosed herein provide various access control apparatuses for an access gate. The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. An access control apparatus for an access gate having a rotator that rotates at a first variable speed in a forward direction, the access control apparatus comprising:

a freewheel/catch mechanism having an input connection that is operatively connected to the rotator, the input connection engaging with an output connection of the freewheel/catch mechanism when the rotator is rotated at the first variable speed in the forward direction and the input connection having substantially unrestricted rotation when the rotator is rotated in a reverse direction opposite the forward direction; and a retardation mechanism operatively connected to the output connection of the freewheel/catch mechanism wherein the retardation mechanism retards motion of the access gate in the forward direction when the first variable speed is above a control-limit speed.

2. The access control apparatus of claim 1 wherein the freewheel/catch mechanism comprises an overrunning clutch.

3. The access control apparatus of claim 1 further comprising a transmission operatively connected to the output connection of the freewheel/catch mechanism through an input element operating at an input speed proportional to the first variable speed, and wherein the transmission has an output element having an output speed that is different than the input speed and wherein the retardation mechanism is operatively connected to the output element of the transmission.

4. The access control apparatus of claim 3 wherein the freewheel/catch mechanism comprises an overrunning clutch.

* * * * *